United States Patent [19]

Petrick

[11] 3,954,202

[45] May 4, 1976

[54] DRAWER DIVIDER SYSTEM

[75] Inventor: Russell E. Petrick, Park Ridge, Ill.

[73] Assignee: Bretford Manufacturing, Inc., Schiller Park, Ill.

[22] Filed: May 20, 1974

[21] Appl. No.: 471,510

[52] U.S. Cl. ..... 220/22.1; 220/22.3
[51] Int. Cl.[2] ..... B65D 25/06; B42F 17/12
[58] Field of Search ..... 220/22, 22.1, 22.2, 220/22.3, 22.4, 22.5, 22.6; 217/7, 33

[56] References Cited

UNITED STATES PATENTS

| | | | |
|---|---|---|---|
| 1,367,245 | 2/1921 | Ebrenz | 220/22.3 |
| 1,415,035 | 5/1922 | Hoffman | 220/22.5 |
| 1,571,330 | 2/1926 | Gollnick | 220/22.1 |
| 1,919,568 | 7/1933 | McCosh | 217/7 |
| 2,175,949 | 10/1939 | Allen | 220/22.3 |
| 3,109,432 | 11/1963 | Regenhardt | 220/22.5 |
| 3,450,296 | 7/1969 | Schreyer | 220/22.1 |
| 3,656,651 | 4/1972 | Itage | 220/22.3 |

*Primary Examiner*—George E. Lowrance
*Attorney, Agent, or Firm*—Wegner, Stellman, McCord, Wiles & Wood

[57] ABSTRACT

A drawer divider system having one or more generally planar divider members extendable in an upright position between the front and rear of a drawer to partition a drawer interior, and a follower block extendable laterally from each divider member for positioning at a desired distance from the front of the drawer for holding objects and coacting friction means on the divider member and the follower block permitting lengthwise adjustment of the follower block along the divider member and retention of the follower block in a desired location.

4 Claims, 4 Drawing Figures

DRAWER DIVIDER SYSTEM

BACKGROUND OF THE INVENTION

This invention pertains to a drawer divider system having the capability of firmly holding objects of various shapes in a drawer by components which can be selectively positioned across the width of the drawer and also with respect to the front of the drawer with versatility in positioning thereof.

It has been known to compartmentalize drawers, such as in kitchen cabinets, wherein slotted members and dividers can be optionally positioned in various arrangements for establishing storage compartments, within limits, as determined by the preformed slots and the length of the dividers. Generally, such constructions have defined storage compartments of fixed size without attempting to adjust to the size of an object and hold the object in position within a drawer.

Drawers of file cabinets are frequently provided with an adjustable back-up member which can be moved forwardly in the drawer to engage behind material stored in the drawer. Such a structure does not have any flexibility in adapting to the width of objects to be stored in a drawer and normally has moving parts involved in mounting the member for adjustment and then holding the member in a locked position.

SUMMARY

A primary feature of the invention disclosed herein is to provide a drawer divider system which provides for firm holding of objects of varying sizes within a drawer by the use of one or more divider members that can be positioned to extend from front to rear of the drawer and a follower block mounted to a divider member for movement along the length of the divider member and frictionally engaged therewith for retention in an adjusted position. The follower block has a follower section extendable outwardly from the divider member and of variable length to engage behind an object in the drawer.

In cabinets for storage of audio visual materials, for example, it is necessary to have the capability for storage of packs of video tape and/or film strips, with these objects coming in various sizes, thicknesses, and weights. Some of these objects are normally stored upright on edge and are unstable. Ideally, these objects should be stored toward the front of the drawer and in a manner whereby identifying indicia on the objects is visible. With the structure disclosed herein, one or more of the divider members can be positioned transverse to the width of the drawer, dependent upon the size of the objects to be stored and a follower block extended laterally from each of the divider members and in frictional engagement therewith. The follower block may be adjusted to a position immediately behind the object or objects and held in that position to firmly hold the objects toward the front of the drawer.

Increased versatility and utility for the drawer divider system is provided by the construction of the divider member having upper and lower guide channels for receiving upper and lower tabs extending from the follower block and which may be bent to an angle to provide the desired amount of frictional engagement with the divider member. The follower block includes a follower section extending outwardly at a right angle from the divider member for positioning behind an object and which is constructed for variation in length dependent upon the size of the object to be engaged. The follower block also has a member positioned for easy manual engagement to assist in adjustment thereof.

DESCRIPTION OF THE PREFERRED EMBODIMENT

Figure 1:
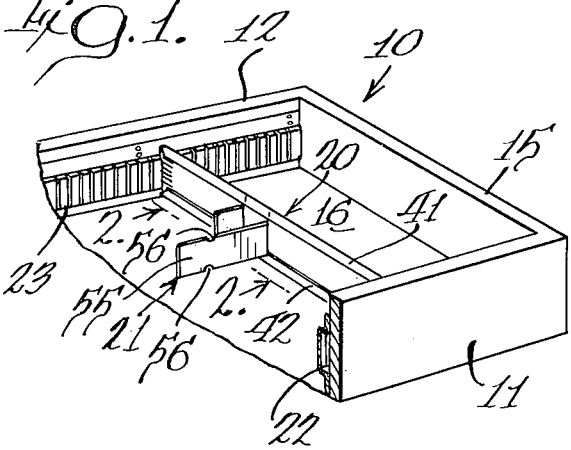
FIG. 1 is a fragmentary perspective view of a drawer having a drawer divider system positioned therein.

A drawer, shown separate from a supporting cabinet, is indicated generally at 10 in FIG. 1, with a front panel 11 and a back panel 12 being interconnected by a pair of side panels, with a right side panel being identified at 15. A drawer bottom 16 provides for support of objects within the drawer.

The drawer divider system includes one or more generally planar divider members 20, a follower block or follower member 21 associated with each divider member 20, and a pair of mounting members 22 and 23 mounted to the front and rear panels, respectively, of the drawer.

With storage of various size objects in the drawer, as previously described, one or more of the planar divider members 20 can be extended upright from front to rear of the drawer and at a desired location laterally thereof. A follower block 21 is manually moved toward the front of the drawer to a supporting position so as to engage behind or bear against the object, such as a video tape or film strip receptacle, and have the object supported in a desired manner toward the front of the drawer.

Figure 2:
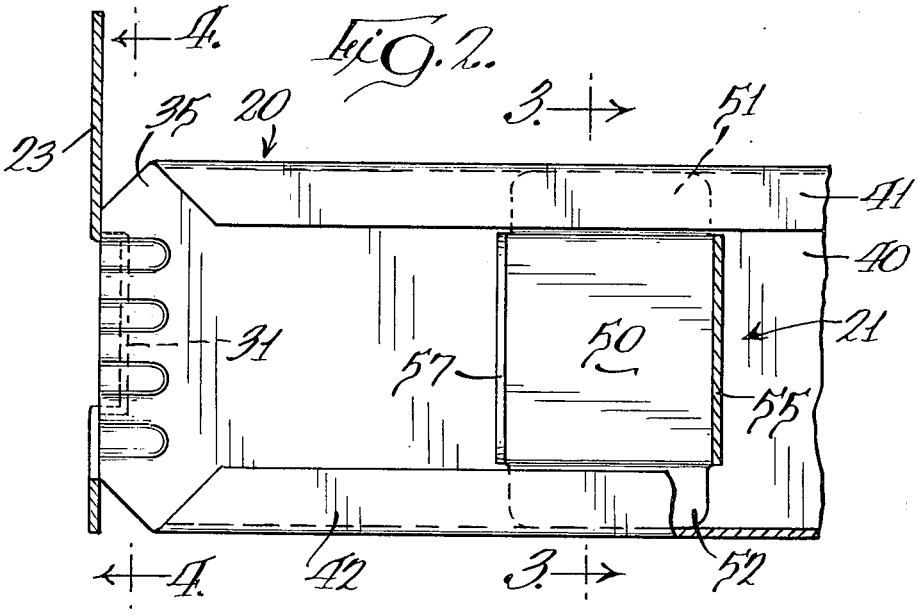
FIG. 2 is a fragmentary vertical section on an enlarged scale, taken generally along the line 2—2 in FIG. 1.
Figure 4:
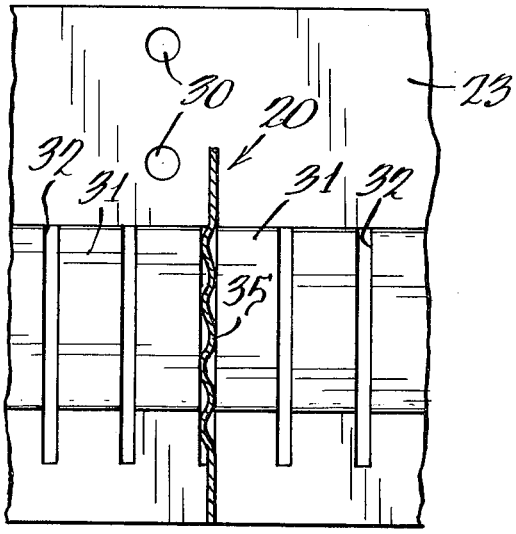
FIG. 4 is a vertical section, taken generally along the line 4—4 in FIG. 2.

The mounting members 22 and 23 are of the same construction, with mounting member 23 being shown particularly in FIGS. 2 and 4. This mounting member has a series of openings 30 to receive fastening members for attaching the mounting members to the front and rear panels of the drawer. Intermediate the height thereof, the mounting member is provided with a series of raised projections 31 separated by slots 32. The divider member 20 is of a length to have the opposite ends thereof fitted into a slot 32 in each of the mounting members 22 and 23. As shown in FIG. 2, an end 35 of the divider member is positioned in a slot of the mounting member 23. With a number of the slots 32 provided along the length of the mounting members, it is possible to arrange a plurality of divider members 20 at various locations across the width of the drawer.

The divider member or side member 20 has a generally planar body 40 with a pair of inwardly-turned flanges 41 and 42 turned to lie in spaced parallel relation to an opposite portion of the body 40 and define therewith a pair of guide channels or channel portions with the flange 41 being part of an upper guide channel and the flange 42 being part of a lower guide channel.

Figure 3:
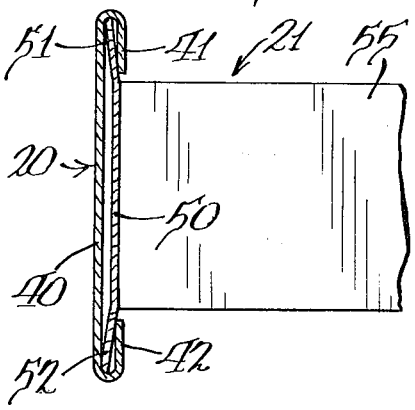
FIG. 3 is a vertical section, taken generally along the line 3—3 in FIG. 2.

The follower block 21 has a generally planar section 50 with nesting portions in the form of an upper tab 51 and a lower tab 52 slidably guided in the upper and lower guide channels of the divider member 20. The follower block is made of a bendable material, such as a medium gauge sheet metal, whereby the tabs 51 and 52 may vary in their angle of deviation from the plane of the planar section 50. As will be seen from FIG. 3, the greater the angle of deviation of the tabs, the greater the resulting frictional force by engagement of the interior surfaces of the guide channels to resist movement of the follower block.

The follower block additionally includes a follower section 55 extending from the planar section 50 generally at a right angle and which, in movement of the follower block, can be brought into position behind an object supported by the drawer. The follower section 55 includes means for varying the length thereof and, more specifically, upper and lower notches 56 which weaken the follower section for bending of the free end thereof to reduce the effective length of the follower section. To facilitate manipulation of the follower block an additional rear panel or manipulating portion 57 extends from the planar section 50 of the follower block. This rear panel may be engaged manually to facilitate rearward movement of the follower block when the follower section 55 is positioned immediately behind an object.

In adapting the drawer divider system to a drawer, the mounting members 22 and 23 are attached to the front and rear panels of the drawer. A divider member 20 is then positioned at the desired location laterally of the drawer by mounting of the ends thereof within a pair of slots 32 in the mounting members. The follower block 21 carried by the divider member is then moved forwardly to a position behind an object stored in the drawer to hold the object in a desired position and to the front of the drawer. Additional versatility is provided by being able to control the frictional holding forces of the follower block by controlling the angle of the tabs 51 and 52 and also controlling the effective span of the follower block by bending a part thereof along the weakening notches 56 of the follower section 55.

I claim:

1. A drawer divider system including, a generally planar divider member extendable upright between a pair of opposed drawer surfaces to partition a drawer interior, a generally upright follower block extending laterally from said divider member to back up material stored in a drawer, and interengaging means on said follower block and divider member guiding said follower block for sliding linear movement lengthwise of said divider member, said interengaging means including a pair of in-turned flanges extending along the length of said divider member defining a pair of elongate guide channels at the top and bottom of the divider member and a pair of tabs on said follower block positioned one in each of said guide channels, at least one of said tabs having a configuration so as to frictionally engage its guide channel to frictionally hold the follower block at a desired location along the length of the divider member.

2. A drawer divider system as defined in claim 1 wherein said follower block has a first generally planar section with said pair of tabs extending from opposite ends thereof, said follower block being made of deformable material so that each of said tabs may be angularly bent with respect to the planar section to increase frictional engagement with its guide channel.

3. A drawer divider system as defined in claim 2 wherein said follower block has a follower section extending at a right angle to said generally planar section, and said follower section includes a pair of opposed notches to weaken said follower section to facilitate bending so as to vary the length of the follower section.

4. A drawer divider system as defined in claim 2 in which the planar section is provided with a manipulating member spaced rearwardly of the follower block to facilitate adjustment of said follower block.

* * * * *